US005465666A

United States Patent [19]

Niiranen

[11] Patent Number: 5,465,666

[45] Date of Patent: Nov. 14, 1995

[54] METHOD FOR CHANGING RAILWAY SLEEPERS AND EQUIPMENT FOR APPLYING THE METHOD

[76] Inventor: Jaakko Niiranen, Nallenpolku 1, FIN-70400 Kuopio, Finland

[21] Appl. No.: 167,975

[22] PCT Filed: Jun. 23, 1992

[86] PCT No.: PCT/FI92/00197

§ 371 Date: Dec. 27, 1993

§ 102(e) Date: Dec. 27, 1993

[87] PCT Pub. No.: WO93/00477

PCT Pub. Date: Jan. 7, 1993

[30] Foreign Application Priority Data

Jun. 24, 1991 [FI] Finland ..... 913063

[51] Int. Cl.[6] ..... E01B 27/00

[52] U.S. Cl. ..... 104/7.3; 104/7.1

[58] Field of Search ..... 104/2, 5, 6, 7.1, 104/7.3, 7.2, 9

[56] References Cited

U.S. PATENT DOCUMENTS

| | | | |
|---|---|---|---|
| 2,571,183 | 10/1951 | Banton | 104/7.3 |
| 2,624,130 | 1/1953 | Perier | 104/7.3 |
| 2,921,538 | 1/1960 | Croonenberghs | 104/7.3 |
| 3,054,359 | 9/1962 | Christoff | 104/7.3 |
| 3,144,833 | 8/1964 | Christoff et al. | 104/7.3 |
| 3,170,410 | 2/1965 | Christoff | 104/7.3 |
| 3,621,785 | 11/1971 | Fearon et al. | 104/7.3 |
| 3,780,664 | 12/1973 | Holley et al. | 104/6 |
| 4,064,807 | 12/1977 | Theurer | 104/7.3 |
| 4,211,170 | 7/1980 | Theurer | 104/7.3 |
| 4,392,433 | 7/1983 | Nyland | 104/6 |
| 4,890,557 | 1/1990 | Whitaker | 104/7.3 |
| 5,119,723 | 6/1992 | Lovitt | 104/9 |

FOREIGN PATENT DOCUMENTS

| | | | |
|---|---|---|---|
| 57635 | 5/1980 | Finland . | |
| 1004641 | 3/1957 | Germany | 104/6 |
| 2624212 | 10/1982 | Germany . | |
| 213594 | 6/1967 | Sweden . | |
| 363142 | 1/1974 | Sweden . | |
| 340523 | 10/1959 | Switzerland . | |
| 600047 | 6/1978 | Switzerland . | |

*Primary Examiner*—Mark T. Le
*Attorney, Agent, or Firm*—Cushman, Darby & Cushman

[57] ABSTRACT

A method and apparatus for changing railway sleepers is disclosed wherein lifting devices are spaced along a section of railway line to be repaired. The lifting devices simultaneously lift and separate the rails from the sleepers. Thereafter, a plough levels the ground on which new sleepers will be placed. Finally, new sleepers are inserted under the rails. The plough additionally serves to provide a foundation upon which the rails are supported, and should it be necessary, the plough can support the weight of a passing train.

17 Claims, 1 Drawing Sheet

METHOD FOR CHANGING RAILWAY SLEEPERS AND EQUIPMENT FOR APPLYING THE METHOD

BACKGROUND OF THE INVENTION

1. Field of the Invention

The present invention relates to a method and apparatus for changing railway sleepers, and in particular, to a method and apparatus for simultaneously lifting rails and unfastening sleepers, removing the sleepers, and installing replacement sleepers.

2. Description of the Related Art

Sleepers used to support rails are usually made of wood or concrete. Wooden sleepers must be replaced typically at regular intervals. Conventionally, rails first have to be unfastened from the sleepers, and thereafter, the sleepers are pulled out from under the rails. Then, new sleepers are pushed forcibly under the rails by using a machine for changing sleepers and then are fastened to the rails. Concrete sleepers are changed when basic repairs done to the railway line are completed or when track gauge is changed. When the sleepers are replaced by conventional methods, however, sections of a railway network must be closed to traffic. Moreover, conventional replacement equipment is large, complex, and cumbersome. Also, even when working with small scale equipment trains cannot run on the line, and thus, the equipment must be removed to let the trains run. This process takes a lot of time moving the machines away from the lines and putting them back on again.

SUMMARY OF THE INVENTION

The object of the present invention is to provide a method and apparatus for changing railway sleepers, such that, upon implementation of the method or upon use of the apparatus, disadvantages connected with conventional methods can be avoided. In particular, the object of the present invention is to provide a method and apparatus wherein sleepers can be replaced more quickly with less manpower than conventionally possible. Additionally, it is an object of the present invention to provide a method and apparatus for changing sleepers that allow associated equipment to be quickly and efficiently placed upon and removed from the line. Finally, it is an object of the present invention to provide an apparatus easy to configure for use.

To achieve these objections in accordance with the present invention, a plough is used as a foundation base on which rails rest during the work and which can be left under the railway section under repair when work has to be interrupted so that trains can pass. In this way, the plough does not need to be removed from under the rails until the work is completed nor does it need to be repositioned under the rails each time work is started. This capability speeds up work considerably as actual replacement work can be started faster than conventionally possible. During the replacement process, the ground under the line is levelled by using the plough pulled below the rails as the rails are lifted up. Once the ground has been levelled, new sleepers can be placed on an even foundation. In this way, the sleepers are always against a level foundation even if the sleepers are placed in new positions.

In the preferred embodiment of the present invention, new sleepers are placed under rails with the help of a working machine equipped with supporting stands. The working machine lies over the railway line and lifts the rails up. Rails can be simply and securely lifted and sleepers can be replaced easily by using the same working machine. This working machine is positioned at a distance from a lifting device so that a chosen length of the line can be lifted. The working machine is situated preferably behind the plough and/or partly on top of it. The plough is pulled between the lifting device and the working machine by a pulling device fastened to another working machine. The second working machine is situated at some distance from the other devices.

Other objects, features, and characteristics of the present invention as well as the methods of operation of related elements will become more apparent upon consideration of the following description and appended claims with reference to the accompanying drawings wherein like reference numbers designate corresponding parts in the various figures.

DETAILED DESCRIPTION OF THE PRESENTLY PREFERRED EMBODIMENT

Figure 1:
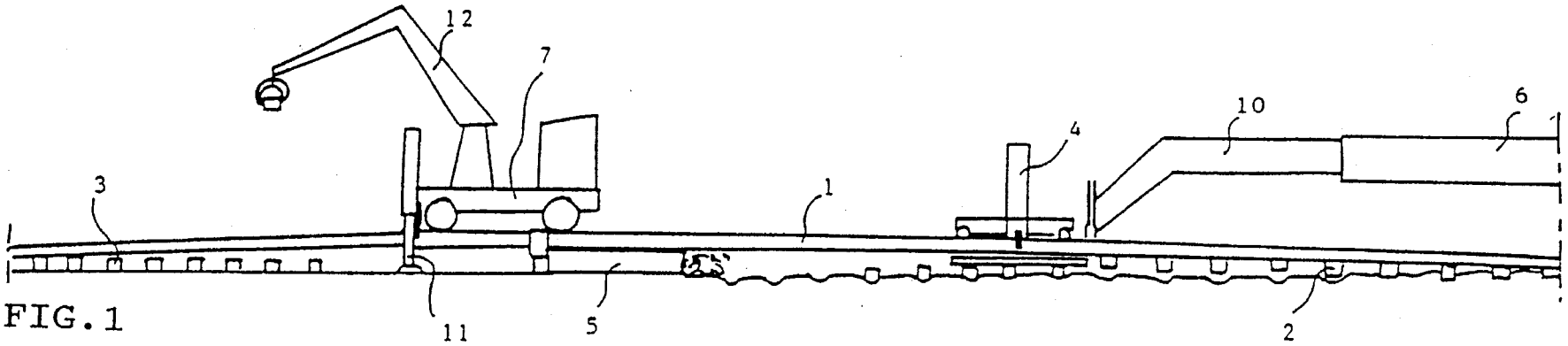
FIG. 1 is a side view of the equipment in accordance with the present invention.
Figure 2:
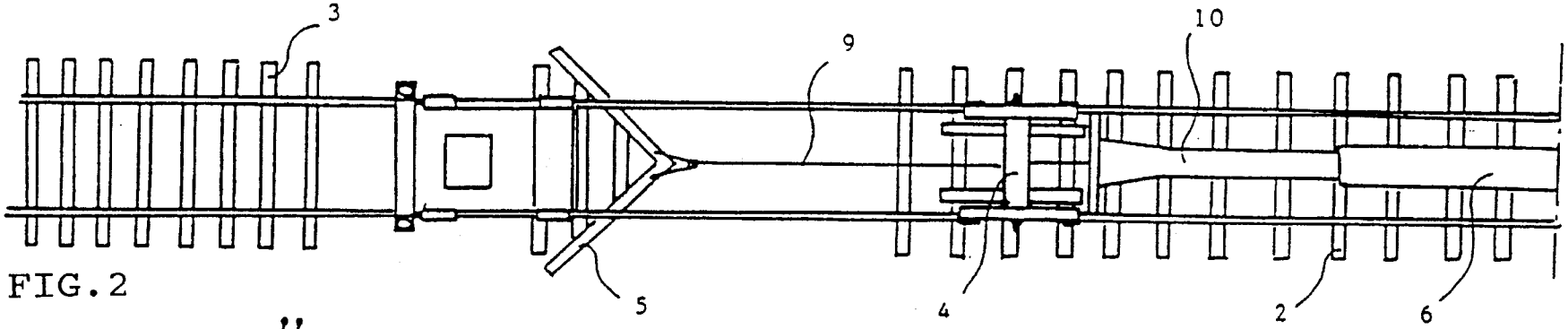
FIG. 2 is top view of the equipment shown in FIG. 1.

In the preferred embodiment shown in FIGS. 1 and 2, the equipment consists of a lifting device 4, a plough 5, and working machines 6 and 7. The lifting device 4 is connected to a boom 10 of the working machine 6. The lifting device is placed above rails 1 so that it will be positioned above sleepers 2. The working machine 6 is placed above the rails at such a distance from the lifting device 4 that it does not force downwardly the rails at the position of the lifting device 4. The working machine 7, which in this embodiment is a railway rig, is placed on top of the rails at a distance behind the lifting device. The working machine 7 is fastened thereafter to the rails. The working machine 7 has supporting stands 11 with which it can lift the rails to the desired height. Additionally, a derrick 12 is disposed on the working machine for sliding new sleepers 3 under the rails.

A plough 5 is placed under the rails so that the working machine 7 is behind it and partly on top of it. The plough 5 is connected to the working machine 6, positioned on the line at a far down line point, by a chain or cable acting as a pulling device 9. The chain 9 is taken under the lifting device and is routed to the boom 10 and thereafter to the working machine 6. The plough 5 is fastened movably to the rails in a previously known way. Additionally, in the back part, the plough 5 has supports for keeping the rails at the proper height and the plough 5 straight. The plough 5 is made of strong materials and, therefore, can be left under the lifted railway section when work must be interrupted. In such a position, the plough 5 acts as a foundation base, and it need not be removed from under the line at the end of each working stage. When a new shift of work begins, the plough 5 is ready immediately for work.

Figure 3:
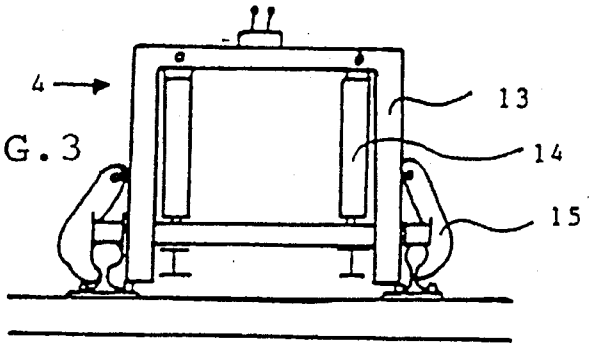
FIG. 3 is a side view of an embodiment of a lifting device in accordance with the present invention.

The lifting device 4 shown in FIG. 3 consists of a frame 13. Cylinders 14 are fastened to the frame 13 and arresters 15 are fastened reversibly to sides of the frame 13 and are fitted with gripping points.

In use, when railway sleepers are changed using the apparatus of the present invention in accordance with the method of the present invention, the lifting device 4 is placed on a selected spot of the line. A lower part of the lifting device 4 is placed against sleepers 2, and the arresters 15 of the lifting device 4 are turned to a position shown in FIG. 3 so that their gripping points are against rails 1. By energizing the hydraulic cylinders 14, the arresters 15 and the rails fastened to them are lifted upwardly. The lower part of the lifting device 4 abuts the railway sleepers so that spikes and foundation plates are loosened along with the rails. Thereafter, the old railway sleeper is pulled aside. The lifting device 4 is moved forward and the work is repeated.

At the opposite end of the section under repair, the working machine 7 is placed on top of the rails at a distance from the lifting device 4. With the help of its supporting stands, the rails are lifted at this end as well. By using the derrick placed on the working machine 7, new railway sleepers 3 are moved under the rails where the sleepers are fastened thereto. At this stage, sleepers can be slid unhindered under the rails from the side.

Further, the plough 5 is placed in front of the working machine 7 and partly under it. Any uneven ground under the line is levelled by pulling the plough 5 within the pulling device 9. The plough 5 vibrates at a high-frequency which is an advantage to overcome friction. Once the plough 5 has been pulled to the lifting device 4, the working machine 6 and the lifting device 4 are moved forward, and the operations are repeated. The working machine 7 is moved forward as well as the work progresses. As the plough 5 moves forward, banks will form on the edges of the moldboards, and the sleepers are placed between these banks under the railway line.

The equipment according to the invention advantageously provides separate, relatively small-sized, and easily handled assemblies. They need not be transferred to a sideline or taken to the nearest station when the work is not in progress.

While the invention has been described in connection with the presently preferred embodiment, it should be understood readily that the present invention is not limited to the disclosed embodiment. Rather, the present invention is intended to cover various equivalent arrangements included within the scope of the appended claims.

I claim:

1. A method for changing a railway sleeper, the method comprising the steps of:

lifting and unfastening simultaneously rails from a sleeper at a first position;

removing the sleeper from under the rails;

placing a plough below the rails to provide a foundation upon which the rails abut during execution of the method and upon which the rails abut while a train passes over the rails;

pulling the plough across a surface, upon which a replacement sleeper will be placed, to level the surface; and placing the replacement sleeper on the levelled surface, and attaching the rails to the replacement sleeper.

2. A method according to claim 1, further comprising placing supporting stands of a working machine on top of the rails and lifting the rails at a second position spaced along the rails from the first position.

3. A method according to claim 2, wherein the plough is placed in front of the working machine and is pulled from the working machine towards the first position by a pulling device.

4. A method according to claim 2, wherein the working machine is placed partially on top of the plough.

5. A method according to claim 1, wherein the lifting step is performed by gripping the rails with arresters of a lifting device, moving upwardly the arresters by a power device so that the rails are lifted and unfastened from the sleeper.

6. A method according to claim 2, wherein the lifting step at the first position is performed by gripping the rails with arresters of a lifting device, moving upwardly the arresters by a power device so that the rails are lifted and unfastened from the sleeper.

7. A method according to claim 3, wherein the lifting step at the first position is performed by gripping the rails with arresters of a lifting device, moving upwardly the arresters by a power device so that the rails are lifted and unfastened from the sleeper.

8. A method according to claim 4, wherein the lifting step at the first position is performed by gripping the rails with arresters of a lifting device, moving upwardly the arresters by a power device so that the rails are lifted and unfastened from the sleeper.

9. Apparatus for changing a railway sleeper, the apparatus comprising:

a lifting device for lifting and simultaneously unfastening the sleeper from rails when the lifting device is disposed on top of the rails;

a plough for leveling a surface under the rails and supporting the rails during sleeper replacement when the plough is positioned under the rails; and a first working machine having supporting stands for placing replacement sleepers under the rails when the first working machine is disposed on top of the rails.

10. Apparatus according to claim 9, wherein the lifting device is disposed on top of the rails, the plough is positioned under the rails, and the first working machine is placed behind the plough.

11. Apparatus according to claim 9, wherein the lifting device is disposed on top of the rails, the plough is positioned under the rails, and the first working machine is placed partially above the plough.

12. Apparatus according to claim 9, further comprising a second working machine for pulling the plough when the second working machine is disposed on the rails and spaced from the first working machine, a pulling device attached at one end to the second working machine and attachable at the other end to the plough.

13. Apparatus according to claim 10, further comprising a second working machine for pulling the plough, the second working machine being disposed on the rails spaced from the first working machine, a pulling device attached at one end to the second working machine and at the other end to the plough.

14. Apparatus according to claim 12, wherein the second working machine further comprises a boom.

15. Apparatus according to claim 13, wherein the second working machine further comprises a boom.

16. Apparatus according to claim 15, wherein the pulling device is disposed under the rails and the lifting device and is connected to the boom.

17. Apparatus according to claim 9, wherein the lifting device further comprises arresters fastened reversibly to sides of the lifting device and further comprises a power device for moving the arresters vertically.

* * * * *